US007728310B2

(12) United States Patent
Fitzsimmons et al.

(10) Patent No.: US 7,728,310 B2
(45) Date of Patent: Jun. 1, 2010

(54) METHOD FOR THE CHEMICAL SEPARATION OF GE-68 FROM ITS DAUGHTER GA-68

(75) Inventors: Jonathan M. Fitzsimmons, Los Alamos, NM (US); Robert W. Atcher, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 196 days.

(21) Appl. No.: 12/151,865

(22) Filed: May 8, 2008

(65) Prior Publication Data

US 2009/0001283 A1 Jan. 1, 2009

Related U.S. Application Data

(60) Provisional application No. 60/928,783, filed on May 10, 2007.

(51) Int. Cl.
*B01D 59/44* (2006.01)

(52) U.S. Cl. ..... 250/432 PD; 423/2; 252/625; 252/645

(58) Field of Classification Search ..... 250/432 PD, 250/432 R, 428; 423/2; 252/625, 634, 644, 252/645; 600/300, 436
See application file for complete search history.

(56) References Cited

U.S. PATENT DOCUMENTS 6,157,036 A * 12/2000 Whiting et al. ..... 250/432 PD
2003/0129366 A1* 7/2003 Lawrence et al. ..... 428/195
2006/0022127 A1* 2/2006 Zyuzin ..... 250/251

* cited by examiner

*Primary Examiner*—Jack I Berman
*Assistant Examiner*—Nicole Ippolito Rausch
(74) *Attorney, Agent, or Firm*—Bruce H. Cottrell

(57) ABSTRACT

The present invention is directed to a generator apparatus for separating a daughter gallium-68 radioisotope substantially free of impurities from a parent gernanium-68 radioisotope, including a first resin-containing column containing parent gernanium-68 radioisotope and daughter gallium-68 radioisotope, a source of first eluent connected to said first resin-containing column for separating daughter gallium-68 radioisotope from the first resin-containing column, said first eluent including citrate whereby the separated gallium is in the form of gallium citrate, a mixing space connected to said first resin-containing column for admixing a source of hydrochloric acid with said separated gallium citrate whereby gallium citrate is converted to gallium tetrachloride, a second resin-containing column for retention of gallium-68 tetrachloride, and, a source of second eluent connected to said second resin-containing column for eluting the daughter gallium-68 radioisotope from said second resin-containing column.

17 Claims, 4 Drawing Sheets

METHOD FOR THE CHEMICAL SEPARATION OF GE-68 FROM ITS DAUGHTER GA-68

RELATED APPLICATIONS

This application claims the benefit of provisional application Ser. No. 60/928,783, filed May 10, 2007.

STATEMENT REGARDING FEDERAL RIGHTS

This invention was made with government support under Contract No. DE-AC52-06NA25396 awarded by the U.S. Department of Energy. The government has certain rights in the invention.

FIELD OF THE INVENTION

The present invention relates to a radioisotope generator and in particular to a radioisotope generator for the separation of germanium-68 ($^{68}$Ge) from gallium-68 ($^{68}$Ga).

BACKGROUND OF THE INVENTION

Positron Emission Tomography (PET) imaging is a growing field in nuclear medicine due to better resolution associated with detecting the two photons produced from the annihilation reaction after positron decay. To date, most PET imaging has been conducted with F-18 FDG and a cyclotron is necessary for F-18 production. The two-hour half-life of F-18 limits the availability of the isotope to hospitals with a cyclotron or in close proximity to one.

A $^{68}$Ga generator could be prepared at any hospital or research laboratory and allow $^{68}$Ga to be produced when desired over periods of months. In the process of developing $^{68}$Ga imaging agents, in vivo studies with rats have used 15-50 microcuries (μCi) of $^{68}$Ga per rat and 25-29 millicurie (mCi) per patient. $^{68}$Ga imaging compounds could be used for staging of disease, prediction of therapeutic response, monitoring tumor response to treatment and for diagnosis of diseases. The availability of a $^{68}$Ga generator will allow for more research on new radiopharmaceuticals for imaging with $^{68}$Ga and propagate the need for more hospitals to purchase the generator system.

SUMMARY OF THE INVENTION

In accordance with the purposes of the present invention, as embodied and broadly described herein, the present invention provides a generator apparatus for separating a daughter $^{68}$Ga radioisotope substantially free of impurities from a parent germanium-68 radioisotope, the apparatus including a first resin-containing column containing parent $^{68}$Ge radioisotope and daughter $^{68}$Ga radioisotope, a source of first eluent connected to the first resin-containing column for separating daughter $^{68}$Ga radioisotope from the first resin-containing column, the first eluent including citric acid whereby the separated gallium is in the form of gallium citrate, a mixing space for admixing hydrochloric acid and separated gallium citrate whereby gallium citrate is converted to gallium tetrachloride, a second resin-containing column for retention of $^{68}$Ga tetrachloride, a source of second eluent consisting essentially of water or a weak buffer solution connected to the second resin-containing column for eluting the daughter $^{68}$Ga radioisotope from the second resin-containing column for subsequent labeling of target molecules, and, a source of third eluent comprising a chelator at a predetermined pH connected to the second resin-containing column for eluting the daughter $^{68}$Ga radioisotope from the second resin-containing column in the form of a chelated $^{68}$Ga for subsequent imaging applications. In one embodiment, the chelator is citric acid.

The present invention still further provides a generator apparatus for separating a daughter $^{68}$Ga radioisotope substantially free of impurities from a parent $^{68}$Ge radioisotope, the apparatus including a first resin-containing column containing parent $^{68}$Ge radioisotope and daughter $^{68}$Ga radioisotope, a source of first eluent connected to the first resin-containing column for separating daughter $^{68}$Ga radioisotope from the first resin-containing column, the first eluent including citric acid whereby the separated gallium is in the form of gallium citrate, a mixing chamber for admixing hydrochloric acid and separated gallium citrate whereby gallium citrate is converted to gallium tetrachloride, a second resin-containing column for retention of $^{68}$Ga tetrachloride, and, a source of second eluent connected to the second resin-containing column for eluting the daughter $^{68}$Ga radioisotope from the second resin-containing column.

DETAILED DESCRIPTION

Figure 1:
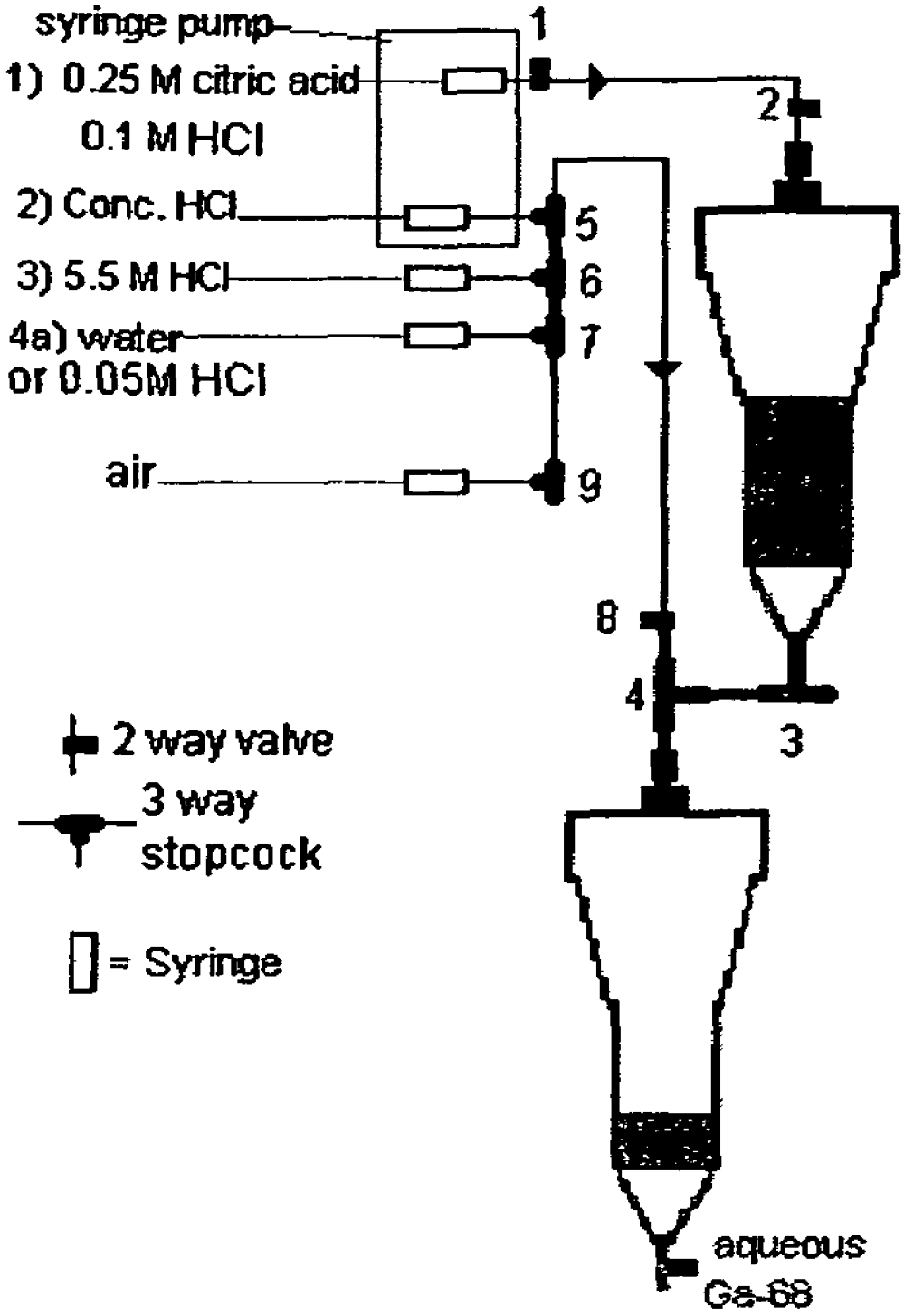
FIG. 1 shows a schematic drawing of one embodiment of the present invention with the two columns.

The present invention is concerned with production of $^{68}$Ga available in a suitable form for the development of radiopharmaceuticals for diagnosis in nuclear medicine. A two-column purification method has been used to produce $^{68}$Ga free from chelators, strong acids, and organic contaminants. The gallium is in an aqueous form at a pH between 0.5-2.0 with an activity from 0.5-10 mCi/mL. Depending on the form of $^{68}$Ga needed, a second column can be eluted with water for radiolabeling bioconjugates or with chelators. In an un-optimized radiolabeling experiment of the eluted gallium, 15 μg of a DOTA-antibody conjugate was radiolabeled resulting in 80% radiochemical purity. The elution of a second column can be performed with chelators, such as EDTA, citrate or DTPA to produce $^{68}$Ga complexes for immediate in vivo studies with minimal or no purification needed.

Characteristics of an ideal generator are: the separation should be rapid, produce $^{68}$Ga in either ionic or a weakly chelated form, have minimal $^{68}$Ge breakthrough and other metals, minimal organic and other impurities, contain the highest activity in the smallest volume (>1 mCi/mL), contain no strong chelating agents, be in a weakly buffered solution, sterile and be made with good manufacturing practices. Ideally the pH of the $^{68}$Ga eluent should allow the rapid (<30 min.) formation of radiolabeled antibodies, peptides or small molecules in the smallest possible volumes (<0.2 mL). Most $^{68}Ge/^{68}Ga$ generators lack one of the ideal characteristics listed leading to limited number of generators in use.

The present invention provides a two-column radionuclide generator that delivers short-lived $^{68}Ga$ upon elution from a solid phase with germanium-68 absorbed on the stationary (resin) phase. The two-column system produces $^{68}Ga$ free of sulfuric acid and chelators, and can be used to synthesize radiopharmaceuticals. If desired, the second column can be eluted with chelators such as EDTA, citrate or DPTA so $^{68}Ga$ radiopharmaceuticals can be made directly on the column and used in imaging studies without purification.

The approach of the present invention can produce $^{68}Ga$ free of strong acids, free of chelators and the product in a small volume. The eluted $^{68}Ga$ is in a form that can be readily and easily radiolabeled with bio conjugates, and the column system can be setup to produce chelated $^{68}Ga$ for injections without subsequent purifications.

A two-column system using a micro column as the second column offers the following benefits. First, gallium chloride ($GaCl_4$) is strongly absorbed to a resin such as Ag 1×8 compared to the germanium thus allowing easy separation of $^{68}Ga$ from germanium breakthrough. Second, the micro column allows for removal of cations, chelating molecules, organic debris, and strong acids from the solution. The selectivity of Ag 1×8 for sulfuric acid and citrate are lower than for chloride ion at the concentrations used in column 2 (per BioRad manual for the resin Ag 1×8). The small contaminants from most generators can hinder labeling microgram quantities, such as labeling receptor ligand material. Third, the column concentrates the $^{68}Ga$ in a small volume (from about 1-2 ml). Fourth, the gallium is in a solution with a pH of 0.5-2.0 and the solution does not contain a significant concentration of strong acids. Fifth, elution of the micro column with chelators can produce $^{68}Ga$ imaging agents for immediate in vivo studies with minimal or no purification.

Figure 2:
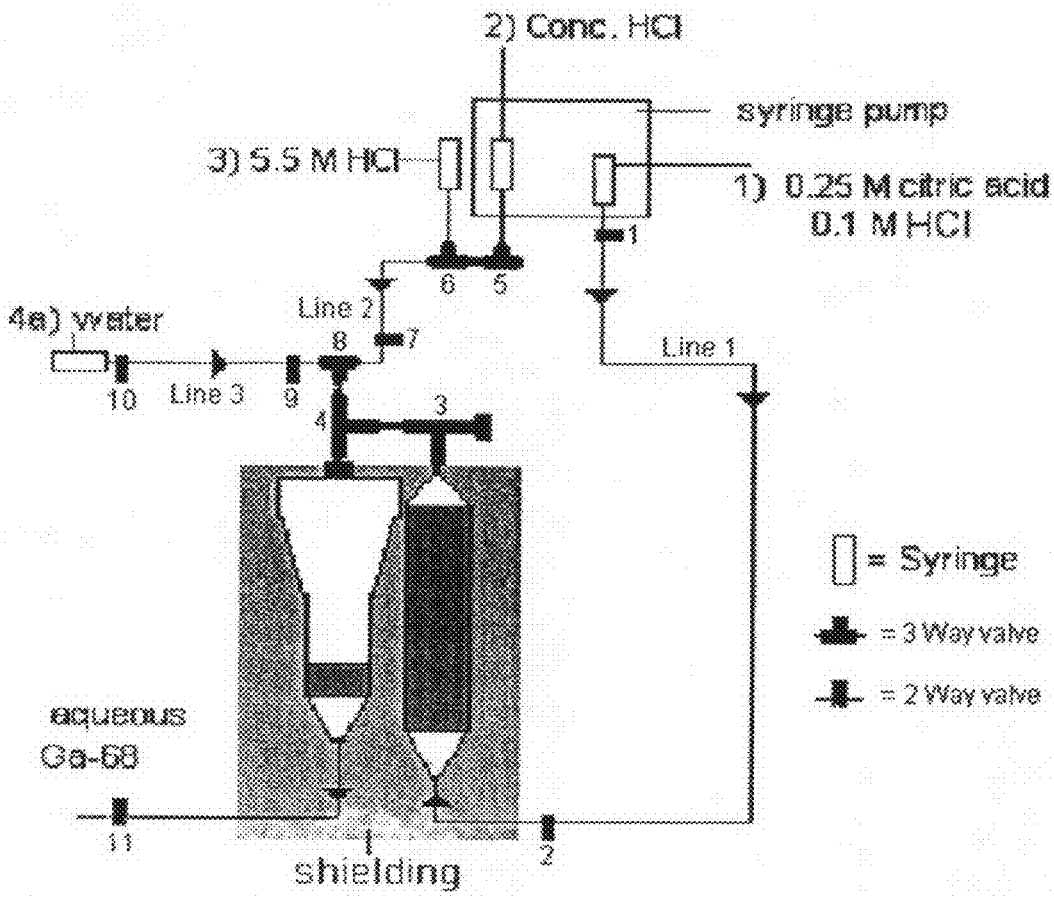
FIG. 2 shows a schematic drawing of another embodiment of the present invention with columns configured in an inverted flow arrangement between the first resin column and the second column.
Figure 3:
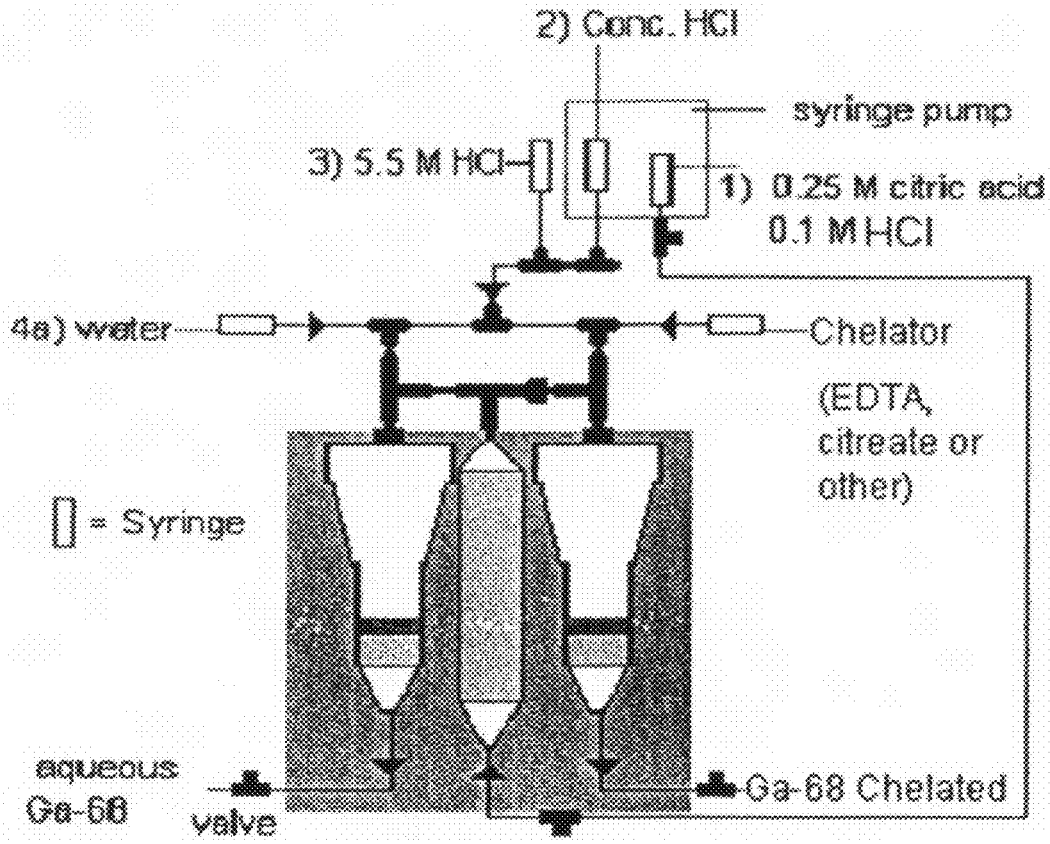
FIG. 3 shows a schematic drawing of another embodiment of the present invention with multiple secondary columns configured in an inverted flow arrangement between the first resin column and the secondary columns for elution with different eluents.
Figure 4:
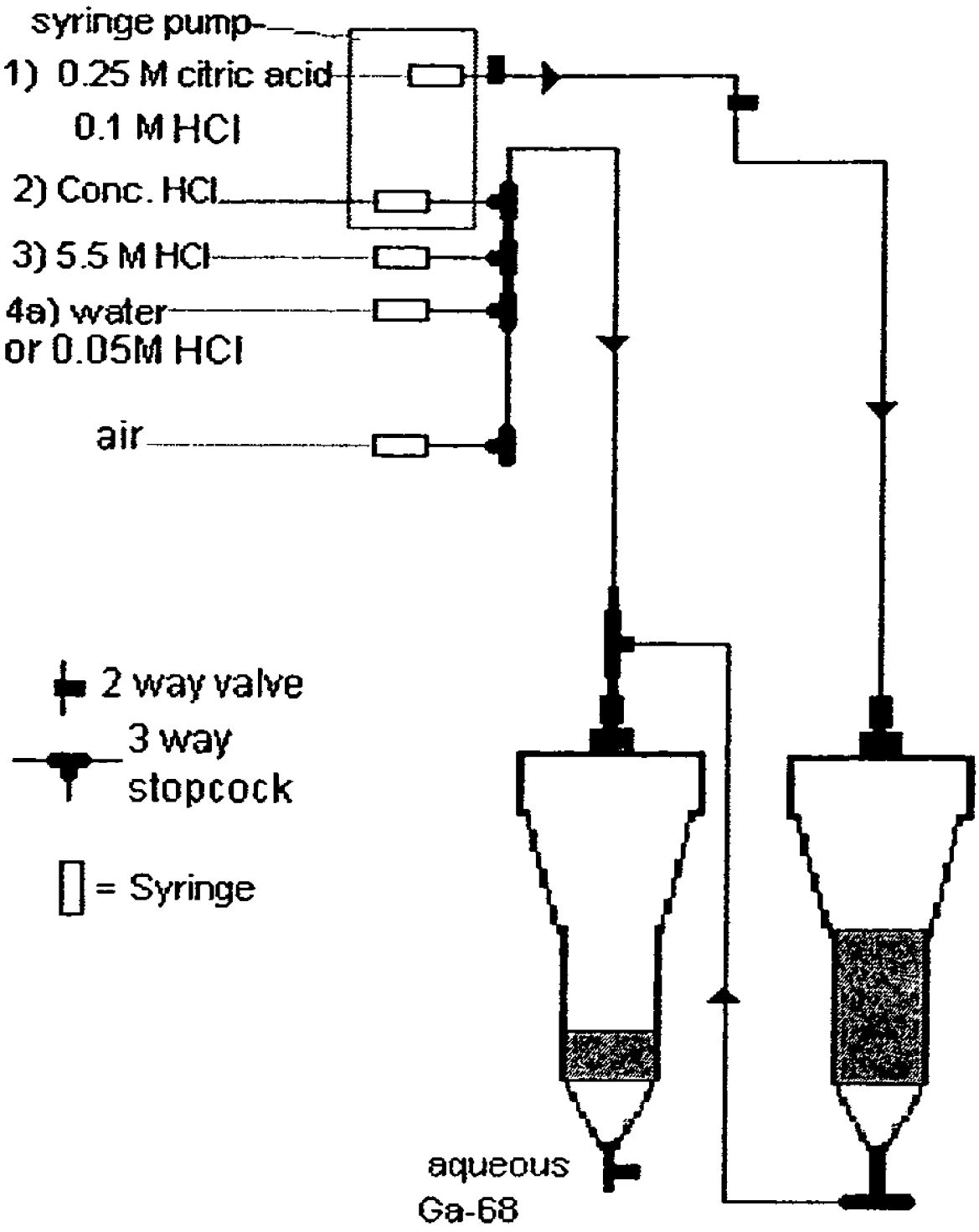
FIG. 4 shows a schematic drawing of another embodiment of the present invention where the first and second columns are parallel in configuration and the flow is in the same direction.

The $^{68}Ga$ can be separated from the secondary column (second or third column depending upon the particular arrangement such as shown in FIGS. 2 and 3) by use of water or a weak buffer solution where subsequent labeling of target molecules is intended. Such a weak buffer solution will generally have a pH of about 4 or less. One suitable weak buffer solution is a 0.05M HCl solution. For imaging, the $^{68}Ga$ can be separated from the secondary column by use of an eleuent including a chelator. An exemplary chelator is citric acid although other chelators are well known to those skilled in the art.

The present invention is more particularly described in the following examples that are intended as illustrative only, since numerous modifications and variations will be apparent to those skilled in the art.

EXAMPLE 1

The columns, resins or absorbents, and low pressure fittings were purchased from Bio-Rad and other reagents were purchased from Sigma Aldrich or Fisher. Ge-68/Ga-68 material was supplied by the Isotope Production Facility (IPF) at Los Alamos National Laboratory. Elution buffer 1 was made by dissolving 12 grams of citric acid (0.25 M) in 250 mL of chelexed treated 18 MΩ water followed by addition of 2.155 mL of concentrated HCl (0.1 M) and the final elution buffer was either chelexed treated 18 MΩ water or 0.05 M HCl. In all experiments column 1 (glass econo-column catalog # 737-1006 or #737-0711 Bio-Rad) had a bed volume of 3 mL and when used column 2 (glass econo-column catalog # 737-0506 Bio-Rad) had a bed volume of Ag 1×8 (100-200 mesh) was 0.25 mL and glass wool was added to the top. Prior to use the columns were washed with 3 mL of 10 M HCl followed by 3 mL of chelexed treated 18 MΩ water, and this was repeated 5 times and all tubing, glass wool and syringes were washed with 2×2 mL of 10 M HCl followed by 2×2 mL of chelexed treated 18 MΩ water, then 2×2 mL of the corresponding eluent. In all configurations connecting syringes to the columns was accomplished with tygon tubing formulation B-44-4× [for syringe 1 and the elution manifold (ID=1.6 mm, OD=4.8 mm, wall thickness=1.6 mm), and in configuration 3 for the final elution buffer (ID=1.6 mm, OD=3.2 mm, wall thickness=0.8 mm)]. The tubing was cut in lengths of 48-51 cm with a dead volume of about 1-1.2 mL and tubing retainers were used on for connecting tubing to columns 1 and 2, and all syringes were connected to either a two-way valve or a three way stopcock. A KD scientific syringe infusion pump model 100 was modified to hold 2 syringes and programmed to elute a 5 mL Becton & Dickinson plastic syringe with a flow rate of 86 mL/hr or 1.4 mL/min. This was used to elute column 1 by eluting with 5 mL of elution buffer 1 at a flow rate of 1.4 mL/min, when completed the syringe was filled with 2.5 mL more of elution buffer 1, loaded into the syringe pump and used to finish the elution of column 1. When column 2 was used a second syringe was added to the syringe pump to elute the concentrated HCl into column 2 for mixing with the eluent from column 1 and three different syringes were used. As a first syringe, a 5 mL Becton & Dickinson plastic syringe delivered 5 mL of concentrated HCl with a flow rate of 1.4 mL/min. As a second syringe, a 10 mL Fortuna plastic syringe delivered 9 mL of concentrated HCl with a flow rate of 2.52 mL/min. As a third syringe, a 20 mL Fortuna plastic syringe delivered 14 mL of concentrated HCl with a flow rate of 3.92 mL/min. The absorbents used in column 1 were packed and the syringe pump was used to wash the column with 50-100 mL of elution buffer 1 and absorbents in column 2 were washed with 20 mL of 5.5 M HCl. For testing the inverted columns the column reservoirs were removed, then the column was treated, absorbent packed as described above and end caps (Bio Rad) were carefully added.

The configuration of the generator system for testing was as follows. To optimize the generator five configurations were used in the experiments listed below and the system was tested for: 1) the volume needed to elute the activity from column 1; 2) the absorbent used in column 1; 3) plumbing to convert the eluent from column 1 to a form that would be retained in column 2; and, 4) the % $^{68}Ga$ yield for 4a) the different absorbents, 4b) when column 1 is inverted, and 4c) the 2 column system. In all configurations tested the syringe pump described above was used to elute the columns.

Configuration 1: The generator was setup according to FIG. 1 and column 1 was connected to column 2 with two separate three-way stopcocks. A syringe with elution buffer 1 was connected via tubing to column 1, and an elution manifold consisting of three separate three-way stopcocks was setup and connected to syringes containing 1) concentrated HCl, 2) 5.5 M HCl, and the 3) the final eluent solution. The elution manifold was connected to column 2 with tubing and a three-way stopcock. A syringe used to blow air through the system was connected to a three-way stopcock and tubing was used to connect it to the elution manifold. This configuration was used to determine the initial "plumbing" needed to convert the eluent from column 1 in a form that would be retained on column 2 and subsequently eluted with the final elution buffer.

Configuration 2: For testing absorbents and the volume of elution buffer 1 needed to elute column 1, the 2 three way stopcocks and column 2 were replaced with a 2 way valve and the elution was collected in a 20 mL plastic scintillation vial.

Configuration 3: The system was setup according to FIG. 2 and the changes from FIG. 1 to FIG. 2 were 1) column 1 was inverted, 2) a three way valve was used to connect the two lines for the concentrated HCl/5.5 M HCl and the final elution buffer to column 2. 3) Two way valves were added to the system. This configuration was used to test the % $^{68}$Ga yield for the system and determine the % Ga retained and eluted from column 2 in the final elution buffer.

Configuration 4: The system was setup according to FIG. 2, however column 2 was removed and a 20 mL scintillation vial was added to collect the elution from the inverted column 1. This configuration was used to determine the properties of column 1 when it is inverted.

Configuration 5: The system was setup according to FIG. 3 and columns 2 and 3 were used to produce either a chelated form of $^{68}$Ga (column 3) or $^{68}$Ga in a buffer for labeling (column 2).

The elution procedure for configurations 3 and 5 was as follows.

I) Prepare system:

Step 1) Prepare 4 with syringes 1=5 mL 0.25 M Citric acid/0.1 M HCl, syringes 2=10 mL concentrated HCl, syringes 3=1 mL 5.5 M HCl and syringes 4=2 mL of elution buffer either $H_2O$ or 0.05 M HCl.

Step 2) Close or open valves and three way stopcocks to isolate column 2 and wash column 2 and tubing lines by eluting with 1 mL of final elution buffer through column 2, then close valves for the final elution buffer and open valves for the HCl line and elute column 2 with 1 mL concentrated HCl.

II) Elution of column 1 and retention on column 2

Step 3) Check valves and three way stopcocks so the HCl line and citric acid/HCl lines are open, and elute column 1 with 5 mL from syringe 1, simultaneously 9 mL of concentrated HCl should be eluted from syringe 2 and both eluents should be mixed in the dead space above column 2. To finish the elution, syringe 1 was refilled with 2.5 mL of elution buffer 1 and syringe 2 was refilled with 4.5 mL of concentrated HCl and both were placed in the syringe pump and the eluted through the system. The $^{68}$Ga should be retained on column 2.

III) Wash Step

Step 4) Valves and the three way stopcocks should be turned to isolate column 1 and only column 2 should be open for elution bluffers, then column 2 should be eluted with 1 mL from syringe 3.

IV) Removal of HCl Solution, Preparation for the Final Elution

Step 5) Trace amounts of HCl in column 2 can be removed by pushing air through column 2 or by using an evacuated vial.

V) Final Elution of $^{68}$Ga

Step 6) Valves and three way stopcocks should be turned so column 2 can be eluted with 1 mL from syringe 4, and an evacuated vial or air can be blown through column 2 to remove the final $^{68}$Ga solution. With one syringe pump, this procedure takes ~12 min per elution, however if this system were setup with 2 or 3 programmed syringe pumps the procedure should take ~8.5 min (5.5 min for eluting the 7.5 mL elution buffer 1, 2 min to eluted the 1 mL of 5.5 M HCl and 1 mL of the final elution buffer, and 1 min. for setting up the valves. VI) Column in "safe mode" Turn all valves to the off position. For column 2, storage should be with either 5.5 or 0.05 M HCl.

Purpose of Valves in FIG. 2

Valves 1, 2, 5, 6, 7, 9 and 10 are used to isolate line 1, 2, and 3 so dead volume of the system is minimized. The valves allow lines to be filled with solvent prior to eluting the $^{68}$Ga, and are used to minimize contamination to the syringes. Valves 2, 4, and 11 are used to isolate column 1 and 2 to minimize $^{68}$Ga contamination to the laboratory, making this a safer generator than other generator arrangements. Valve 4 is used to minimize contamination to column 1 from washing and eluting column 2 thus isolating column 1 from column 2, always check valve 4 prior to eluting with any solvent. Accidentally leaving the valve open will alter the performance of the generator. Valves 7, 8, and 9 are used minimize solvent mixing of concentrated HCl and the final elution buffer. Valve 3 is used as a spacer and is not used to change the flow in configurations 1 and 3, however in configuration 5 valve 3 would be used to decide which second column would be used for the elution of $^{68}$Ga. This valve was used to minimize the contamination when eluting with a chelating agent or elution buffer 1.

"Safe mode"—Isolation of Column 1

Various laboratories that have used the commercial Ge-68/Ga-68 have had contamination issues as a result of the column drying out and both isotopes are volatile. For configuration 3 and 5 contamination from the volatile isotopes should minimized because in both configurations column 1 is inverted and thus the activity will be wet after elution and the $^{68}$Ga is not stored in a chloride form on the column. To leave the system in a "safe mode" the valves in the solvent lines should be turned to the "OFF" position and all valves and three way stopcocks should be turned "OFF" thus isolating column 1. If the procedure is followed the inverted column 1 will have solvent up to valve 4 in FIG. 2, and if valves 2 and 4 are in the "Off" position the column will not dry out.

For the following experiments the initial activity on the column and activity in the eluents was determined with a high purity germanium detector. Great care was taken in getting similar geometries between activity on the column and in the vials. The % Ga-68 yield was calculated by=(Activity in eluent/Column activity before) * 100. When the flow rate of the elution buffer 1 was 1.4 mL/min the amount of Ge-68 breakthrough determined by the amount of $^{68}$Ga in solution after 24 or 48 hours was not detectable by a high purity germanium detector. Unless noted the $^{68}$Ga activity was not decay corrected for the elution time, which was typically ~5-7 min. when eluting 1 column and 10-12 min. when eluting 2 columns.

Volume Needed to Elute Column 1

In configurations 3 eluting the system with 5 mL of elution buffer 1 resulted in a % $^{68}$Ga yield of 57%, but eluting the system with 7 mL resulted in a % $^{68}$Ga yield of 80-90%. In configuration 2 eluting with 7 or 10 mL of elution buffer 1 resulted in similar results of % $^{68}$Ga yield 63-75%. To maximize the % Ga yield and minimize the time 7-7.5 mL of elution buffer 1 was used in subsequent experiments.

Absorbent for Column 1

Configuration 2 was used to determine the % Ga yield for the following absorbents Ag 1×8 (50-100, 100-200, 200-400 mesh), Ag 1×4 (50-100$^{i}$, 100-200 mesh) and MP1 (50-100 mesh). Approximately 0.1 mCi of Ge-68/Ga-68 in the elution buffer was loaded on the column, the procedure described above was used to determine the % $^{68}$Ga yield in the eluent for each absorbent. Ag 1×8 (50-100 mesh), Ag 1×8 (100-200 mesh) 69.4+/−4.4% (n=8), range 75.3 −63.4%, Ag 1×8 (200-

400 mesh) 69.4+/−4.4% (n=8), range 75.3 −63.4%, Ag 1×4 (50-100 mesh), Ag 1×4 (100-200 mesh) and MP1 (50-100 mesh)

Inversion of Column 1

Configuration 4 was used to evaluate an inverted column containing Ag 1×8 (100-200 mesh), and the column was washed with 10 mL of the citric acid/HCl solution prior to loading with about 0.05 mCi. The column was eluted into 20 mL scintillation vials and the % $^{68}$Ga yield was determined. Thirteen elutions were performed and the % $^{68}$Ga yield slowly decreased from 93.4% to ~82% by elution 6, and elutions 6-13 the average % $^{68}$Ga yield was 80.4+/−2.0 (n=8) with a range of 76.1-82.4%.

Configuration 1 displayed in FIG. 1 with Ag 1×8 (100-200 mesh) as the absorbent in column 1 loaded with about 0.05 mCi was setup. The optimal preconditioning conditions for column 2 and the effective concentration of HCl needed to retain the Ga-68 in column 2 from the mixture of column 1 eluent and concentrated HCl were determined. Column 2 was preconditioned with 5.5 M HCl then the elution procedure outlined above was followed with 5 mL of elution buffer 1 and 5 mL of concentrated HCl and activity was determined for 1) the pooled elutions of elution buffer 1, concentrated HCl and 5.5 M HCl washing and 2) the final elution from column 2 and the % $^{68}$Ga in each fraction was determined. The separation was performed the equal amounts of concentrated HCl and elution buffer 1 and 28.2% of the total activity was present in the pooled eluent, and 71.8% of the total activity was in the final elution. This separation was repeated and column 2 was preconditioned with 10 M HCl and 22.7% of the total activity was present in the pooled eluent, and 77.3% of the total activity was in the final elution buffer. For the following separations column 2 was preconditioned with 10 M HCl, the separation was repeated with ratios of concentrated HCl/elution buffer of 1) 9 mL/5 mL and 2) 14 mL/5 mL. In both conditions the pooled eluents contained 4.5% of the total activity, and 95.5% of the total activity was in the final elution buffer.

Configuration 3 was used with Ag 1×8 (100-200 mesh) as the absorbent in column 1 and the procedure outlined above was used with preconditioning of column 2 with 1 mL of concentrated HCl and the ratio of concentrated HCl/elution buffer 1 was 13.5 mL/7.5 mL. The activity was determined in 1) the column before elution 2) the pooled elution buffer 1 and 3) the final elution and the % $^{68}$Ga yield was determined using the activity in the final elution/the activity of the column before elution, and the % $^{68}$Ga in the final elution was determined from the activity in the final elution/the sum of the activities in the pooled and final fractions. The % $^{68}$Ga in the final elution was 95.79+/−5.36% (n=5) range=92.83-98.8% and the % $^{68}$Ga yield for the process was 87.50+/−5.9% (n=5).

The $^{68}$Ga yield from generator was determined as follows. To minimize the effect of air bubbles on the % Ga yield and get a more accurate performance of the generator, the activity on the column at equilibrium was established with 5 counts. Configuration 3 was used and column 1 was eluted with 40 mL of the elution buffer 1 to reduce the amount of air trapped in the column. Then the 2 column generator was eluted 2 times a day when the gallium was at equilibrium and the % Ga-68 was determined in 1) the pooled 0.25 M citric acid/0.1 M HCl, concentrated HCl and 5.5 M HCl and 2) the final elution and the overall Ga-68 yield of the 2 column generator.

For the development of the $^{68}$Ga generator, various configurations were used in testing to produce an optimized system. The initial design utilized plastic columns where column 1 was eluted into a centrifuge tube containing an equal volume of concentrated HCl. This design produced a solution with an effective concentration of HCl of 5.5 M that was added to column 2. Although this approach does work to produce $^{68}$Ga for labeling, the purification time is greater than 15 min, and part of the research focused on the automation of this generator system. Configuration 3 was used to perform the initial non-radioactive work testing the mixing of the concentrated HCl with eluent from column 1. Turbulence from the mixing of the concentrated HCl and the eluent from column 1 was observed in valve 4. To overcome the need for a mixing well and added bulk associated with shielding, the narrowest internal diameter column from Bio-Rad (catalog #737-0506, ID=0.5 cm, with a 1 mL maximum volume) was used for column 2. In the initial testing it was determined the narrow column would retain buffer after the syringe pump had stopped and the solution could be removed by blowing air through the column. The ability of column 2 to retained buffer is important because during the elution procedure preconditioning column 2 with hydrochloric acid would cause some to be retained and this acts as a mixing well.

Column 1 Absorbent

The % Ga yield from column 1 was determined utilizing configuration 2, and the following absorbents were tested 1) Ag 1×8 (50-100 mesh), 2) Ag 1×8 (100-200 mesh) 3) Ag 1×8 (200-400 mesh), 4) Ag 1×4 (50-100 mesh), 5) Ag 1×4 (100-200 mesh) and 5) MP1 (50-100 mesh). The % Ga yields were: 1) 69.4+/−4.4 (n=8) for Ag 1×8 (100-200 mesh), 2) 93.8+/−5.1 (n=5) for Ag 1×8 (200-400 mesh), and 3) 99.2+/−3.1 (n=5) for Ag 1×4 (50-100 mesh). It was unclear why the Ag 1×8 (100-200 mesh) had the lowest % $^{68}$Ga yield.

An alternative design with an inversion of column 1 was as follows. To minimize the shielding needed for the generator column was inverted so the geometry of the two columns were parallel. The inverted column has many advantages, trouble shooting guides for column chromatography suggest inverting the column to get better packing of column material and thus reduce channeling. A major advantage of this system over the commercial Ga-68 generator is when configuration 3 is stopped buffer will always cover column 1 and the buffer will be present up to valve 4. Various researchers conducting research with the commercial generator or have had problems with the column drying out and have resulted in contamination problems because both Ge-68 and $^{68}$Ga are volatility. One disadvantage of an inverted column is the column will develop air pockets if the column is removed multiple times or air bubbles are from the system and from the with a syringe pump is any air in the syringe Configuration 1 was used to determine the optimal conditions for elution, and the variables used to optimize the two column generator were 1) preconditioning of column 2, and 2) the molarities of HCl associated with the retention of $^{68}$Ga on column 2. Pre-conditioning column 2 with concentrated HCl versus 5.5 M HCl resulted in a 5% increase of activity in the final eluent (77.3 versus 71.8%) when the same conditions were used in eluting the generator. Increasing the concentration of the HCl from 5.5 to 7.65 M in the mixing of $^{68}$Ga eluent from column 1 and concentrated HCl resulted in a approximately a 20% increase in the % $^{68}$Ga yield (77.3 to 95.5%); however, increasing the concentration of HCl to 8.77 M resulted in no noticeable increase in the $^{68}$Ga yield (95.5% for both). Configuration 3 was used and the procedure outlined above was followed and the % Ga-68 was determined in 1) the pooled 0.25 M citric acid/0.1 M HCl, concentrated HCl and 5.5 M HCl and 2) the final elution and the overall $^{68}$Ga yield of the 2 column generator. For the pooled fraction the %

$^{68}$Ga was 1.38+/−0.26%(n=6) and the amount of $^{68}$Ga retained and eluted from column 2 was 98.6+/−0.26% (n=6). The % $^{68}$Ga yield from the 2-column system was 89.5+/−7.3% (n=6).

In the process of determining the amount of $^{68}$Ga on the column, column 1 is removed, capped and the activity is determined, and for eluting the system the syringes are removed and filled with solution. This approach introduces air bubbles to the column, which leads to an increase in the amount of $^{68}$Ga eluted off the column. To minimize the effect of air bubbles on the % Ga yield, the activity on the column at equilibrium was established with 5 counts. Then column 1 was eluted with 40 mL of the citric acid/HCl to reduce the amount of air trapped in the column. Then the 2 column generator was eluted 2 times a day when the gallium was at equilibrium and the % $^{68}$Ga was determined in 1) the pooled 0.25 M citric acid/0.1 M HCl, concentrated HCl and 5.5 M HCl and 2) the final elution and the overall $^{68}$Ga yield of the 2 column generator.

Although the present invention has been described with reference to specific details, it is not intended that such details should be regarded as limitations upon the scope of the invention, except as and to the extent that they are included in the accompanying claims.

What is claimed is:

1. A generator apparatus for separating a daughter gallium-68 radioisotope substantially free of impurities from a parent germanium-68 radioisotope, the apparatus comprising:

a first resin-containing column containing parent germanium-68 radioisotope and daughter gallium-68 radioisotope;

a source of first eluent connected to said first resin-containing column for separating daughter gallium-68 radioisotope from the first resin-containing column, said first eluent including citric acid whereby the separated gallium-68 is in the form of gallium citrate;

a mixing space connected to said first resin-containing column for admixing a source of hydrochloric acid with said separated gallium citrate whereby gallium citrate is converted to gallium tetrachloride;

a second resin-containing column in connection with said mixing space for retention of gallium-68 tetrachloride as said gallium tetrachloride is passed therethrough;

a source of second eluent consisting essentially of water or a weak buffer solution connected to said second resin-containing column for eluting the daughter gallium-68 radioisotope from said second resin-containing column for subsequent labeling of target molecules; and, a source of third eluent comprising a chelator at a predetermined pH connected to said second resin-containing column for eluting the daughter gallium-68 radioisotope from said second resin-containing column in the form of a chelated gallium-68 for subsequent imaging applications.

2. The generator apparatus of claim 1 wherein said apparatus includes shielding around the columns to limit exposure of individuals to radiation from the columns.

3. The generator apparatus of claim 2 wherein said first and second columns are configured in a parallel side-by-side arrangement so as to minimize the size of said generator apparatus and to minimize the amount of shielding.

4. The generator apparatus of claim 1 wherein said apparatus includes a third resin-containing column for retention of gallium-68 tetrachloride and said source of second eluent is connected to said second resin-containing column for retention of gallium-68 tetrachloride, and said source of third eluent is connected to said third resin-containing column for retention of gallium-68 tetrachloride.

5. The generator apparatus of claim 2 wherein said first column is in an inverted flow configuration in relation to said second column.

6. The generator apparatus of claim 4 wherein said first column is in an inverted flow configuration in relation to said second column and said third column.

7. The generator apparatus of claim generator apparatus of claim 1 wherein said chelator is citric acid.

8. The generator apparatus of claim 1 wherein said mixing space is a mixing chamber situated between said first column and said second column.

9. The generator apparatus of claim 1 wherein said mixing space is provided by space volume within connecting fluid conduits between said first column and said second column.

10. A generator apparatus for separating a daughter gallium-68 radioisotope substantially free of impurities from a parent germanium-68 radioisotope, the apparatus comprising:

a first resin-containing column containing parent germanium-68 radioisotope and daughter gallium-68 radioisotope;

a source of first eluent connected to said first resin-containing column for separating daughter gallium-68 radioisotope from the first resin-containing column, said first eluent including citrate whereby the separated gallium is in the form of gallium citrate;

a mixing space connected to said first resin-containing column for admixing a source of hydrochloric acid with said separated gallium citrate whereby gallium citrate is converted to gallium tetrachloride;

a second resin-containing column for retention of gallium-68 tetrachloride; and, a source of second eluent connected to said second resin-containing column for eluting the daughter gallium-68 radioisotope from said second resin-containing column.

11. The generator apparatus of claim 10 wherein said second eluent includes a chelator.

12. The generator apparatus of claim 10 wherein said second eluent is water of a weak buffer solution.

13. The generator apparatus of claim 11 wherein said chelator is citric acid.

14. The generator apparatus of claim 10 wherein said apparatus includes shielding around the columns to limit exposure of individuals to radiation from the columns.

15. The generator apparatus of claim 14 wherein said first and second columns are configured in a parallel side-by-side arrangement so as to minimize the size of said generator apparatus and to minimize the amount of shielding.

16. The generator apparatus of claim 10 wherein said mixing space is provided by space volume within connecting fluid conduits between said first column and said second column.

17. The generator apparatus of claim 10 wherein said mixing space is a mixing chamber situated between said first column and said second column.

* * * * *